US005193850A

United States Patent [19]

Lombardo

[11] Patent Number: 5,193,850

[45] Date of Patent: Mar. 16, 1993

[54] PRESSURE SEAL Z-FOLD WITH TRANSFER TAPE

[75] Inventor: Leo Lombardo, Manchester, N.H.

[73] Assignee: Moore Business Forms, Inc., Grand Island, N.Y.

[21] Appl. No.: 901,188

[22] Filed: Jun. 19, 1992

[51] Int. Cl.[5] ..... B42D 1/00

[52] U.S. Cl. ..... 281/2; 281/5; 283/81; 283/101; 283/103; 283/105; 283/106

[58] Field of Search ..... 281/2, 5, 9; 283/56, 283/61, 62, 81, 98, 101, 103, 105, 106; 40/306, 315; 229/16 A, 73, 74, 92.3

[56] References Cited

U.S. PATENT DOCUMENTS

| | | | |
|---|---|---|---|
| 4,598,935 | 7/1986 | Stewart | 283/81 |
| 4,708,368 | 11/1987 | Instance | 283/81 |
| 4,726,972 | 2/1988 | Instance | 428/40 |
| 4,744,161 | 5/1988 | Instance | 281/2 X |
| 4,850,613 | 7/1989 | Instance | 281/5 |
| 4,915,287 | 4/1990 | Volk et al. | 229/70 |
| 4,927,179 | 5/1990 | Ehret et al. | 283/81 X |
| 4,955,640 | 9/1990 | Anderson | 281/2 |
| 5,031,939 | 7/1991 | Webendorfer et al. | 283/81 |
| 5,071,167 | 12/1991 | O'Brien | 283/81 |

*Primary Examiner*—Timothy V. Eley
*Assistant Examiner*—Willmon Fridie, Jr.
*Attorney, Agent, or Firm*—Nixon & Vanderhye

[57] ABSTRACT

A business form, and intermediate for constructing the form, suitable for use as a packing list or invoice. A regular (bond) sheet of paper is constructed into three approximately equal size panels which are Z-folded about fold lines. The first face of the first panel has address indicia printed on it, while the second face of the third panel has two or more strips of transfer tape disposed on it, spaced from each other and parallel to the lines of weakness, facilitating attachment of the form to a package. Invoice information is preferably printed on the first face of the second and third panels. The panels are held together in a packaging slip configuration by strips of pressure seal adhesive. In use, by detaching various portions of the form along perforations the form can be folded about a pressure seal adhesive line between the second and third panels second face adjacent the second fold line, and along the second fold line so that the first face second and third panels (invoices) are readily seen.

20 Claims, 2 Drawing Sheets

FIG. 1
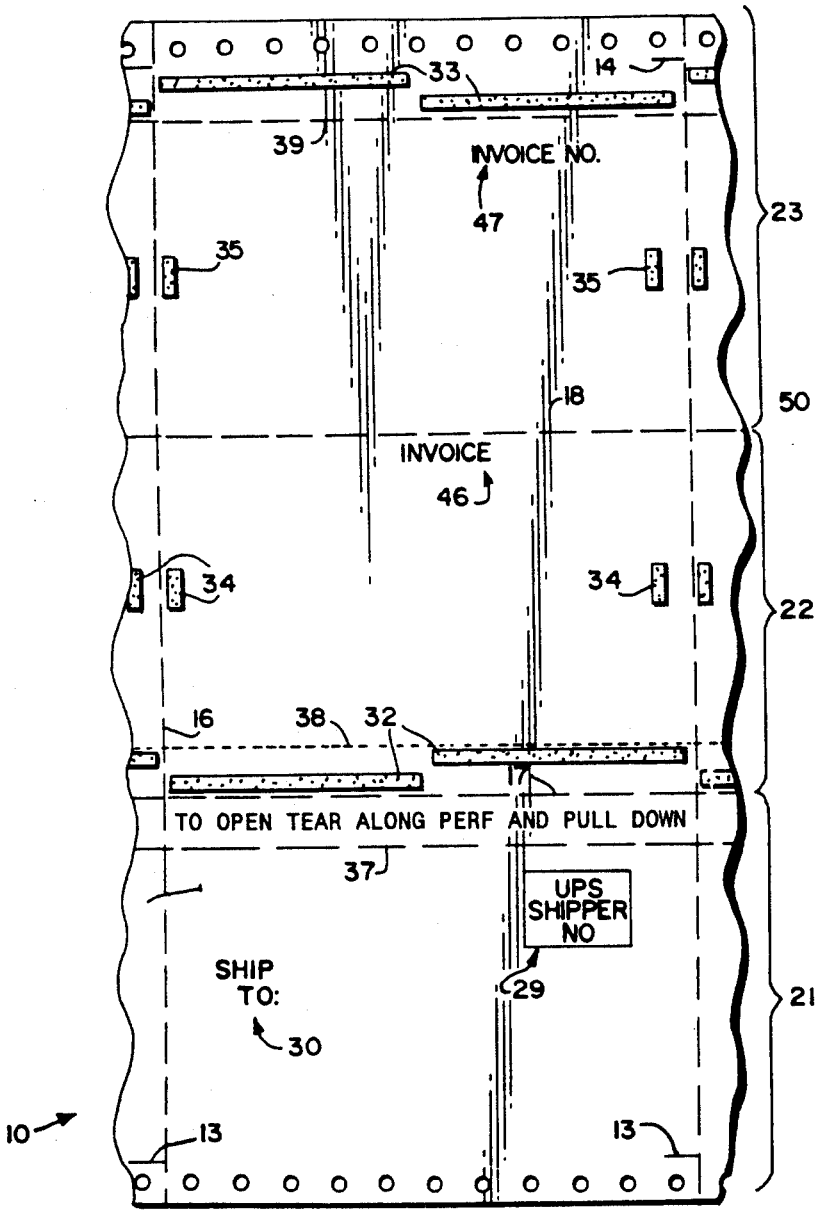
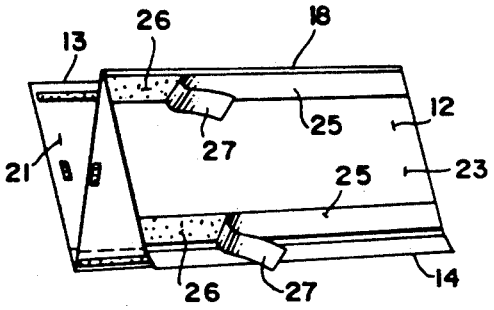
FIG. 3
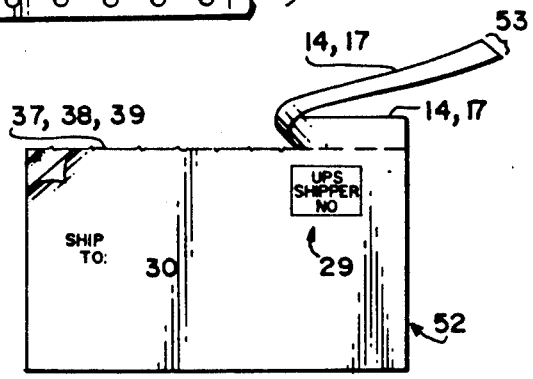
FIG. 4

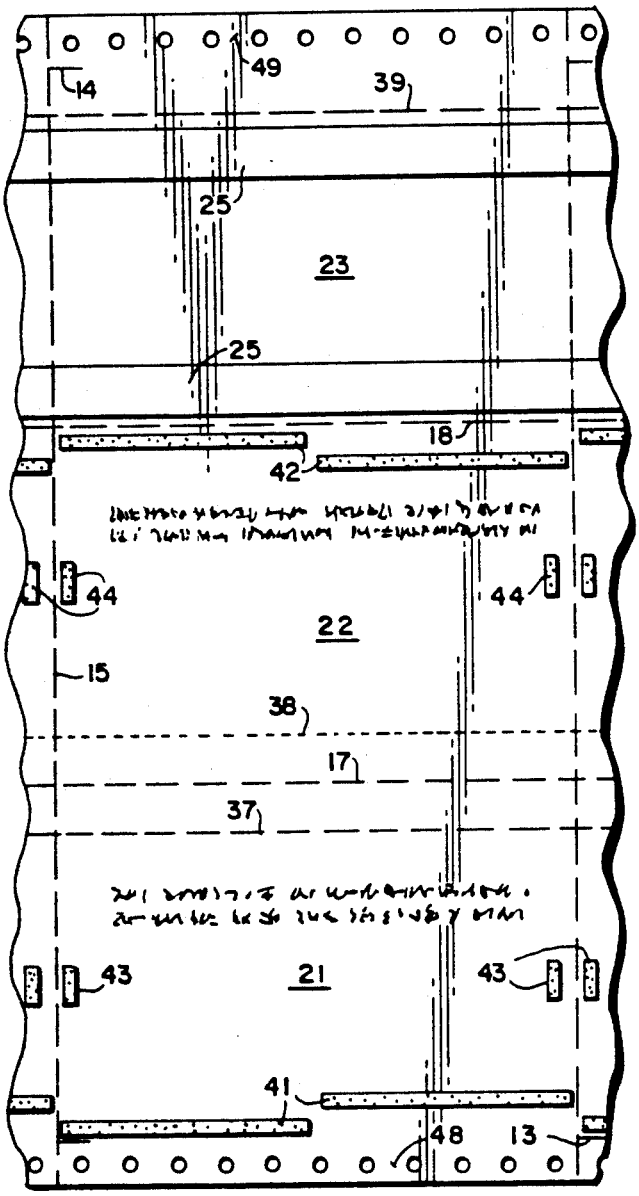
FIG. 2
FIG. 5
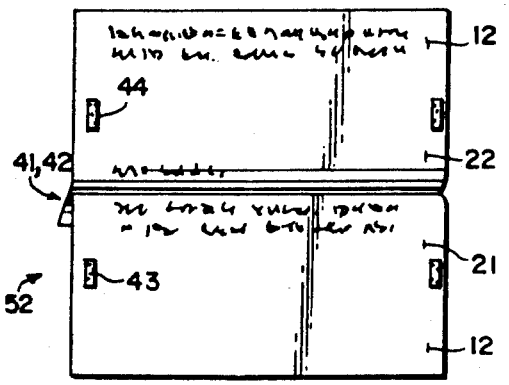
FIG. 6
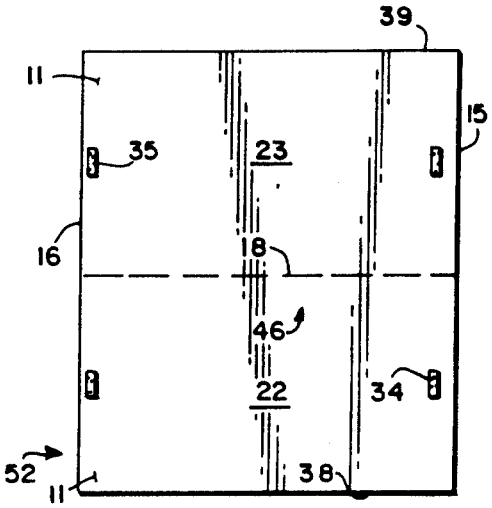

PRESSURE SEAL Z-FOLD WITH TRANSFER TAPE

BACKGROUND AND SUMMARY OF THE INVENTION

It is desirable to be able to construct simple yet effective business forms suitable for use as packaging slips or invoices. One such form is illustrated and described in U.S. Pat. No. 4,955,640. The form illustrated therein is constructed from label stock and with bond paper having edges overlapping the edges of the label stock. The form is Z-folded, the three panels being held together by two strips of pressure seal adhesive or the like. While such a packing list/invoice is an effective product, it is more expensive to make than desirable, primarily because one-third of the form is label stock.

Another packing slip that is commonly utilized is a side stick heat seal product manufactured utilizing a common bond sheet in conjunction with a pressure sensitive label stock. Resealable adhesive is applied to the form using a vertical stream and dot pasting, both on the face and the back of the form. The form is processed through a Siemen's cold fuse laser and then sealed in Z-fold fashion on a modified 4610 sealer, utilizing a trombone attachment along with a standard plow-fold. The form is then detached and applied to a package by means of removing the liner from the label stock. The user removes the invoice by the left stub. While such a form also can be effective, it is far less than optimally desirable. Problems associated with it are: Excess pad lean due to the nature of the side-stick product (inserts must be placed every three to four inches to level off the pad). Due to the excessive leaning refolding on the printer is also a problem. Further, the product is difficult to manufacture due to a wide variety and different types of perfs, zip tabs, adhesive faces and backs, etc., and is costly due to the large amount of label stock. Also the form is difficult to fold and seal on post-processing equipment. Because the form is processed on a cold fuse laser, the heat bands on the sealer often have to be replaced and in such a way to avoid toner. Also the form is difficult to open.

According to the present invention, an intermediate for construction of a business form, and a business form, suitable for use as a packing slip/invoice are provided which overcome the drawbacks discussed above with respect to the prior art. The product according to the invention does not have label stock, therefore the form is easier and less expensive to manufacture. Also it has much less pad lean, and preferably utilizes pressure seal adhesive so that it has all the benefits of ease of manufacture, and ease of handling that a pressure seal form has. The seal is formed consistently on the Moore 4800 Speedisealer® equipment manufactured by Moore Business Forms, Inc. of Lake Forest, Ill. Also there is no problem with toner offset due to perimeter sealer, and the form is extremely easy to open by the end user.

According to one aspect of the present invention, a business form intermediate is provided which comprises the following elements: A sheet of paper having a first face and a second face, first and second edges opposite and substantially parallel to each other, and third and fourth edges opposite to each other and substantially perpendicular to the first and second edges. Means defining first and second fold lines in the sheet extending parallel to the first and second edges, and dividing the sheet into first, second, and third panels roughly equal in size, the second panel being intermediate the first and third panels. Two or more strips of transfer tape disposed on the second face of the third panel, the strips extending substantially perpendicular to the third and fourth edges, and being spaced from each other in the dimension extending from the first to the second edges. Address indicia printed on the first panel first face. First adhesive means disposed on the first face of the second and third panels for holding the second and third panel first faces in face-to-face contact in the business from constructed by the intermediate. And, second adhesive means disposed on the second face of the first and second panels for holding the first and second panel second faces in face-to-face contact in the business form constructed by the intermediate.

First and second lines of weakness extend parallel to the first fold line and straddle the first fold line. The first line of weakness is disposed in the first panel, and the second line in the second panel. Also the second fold line is preferably a line of weakness (perforation). The third line of weakness may be provided extending parallel to the fold lines adjacent the second edge of the intermediate.

The first adhesive means preferably comprises elongated cooperating strips of pressure seal adhesive disposed between the first fold line and the second line of weakness, and between the third line of weakness and the second edge. Also widely spaced patterns of pressure seal adhesive are disposed adjacent the third and fourth edges in the second and third panels. The second adhesive means comprises similar cooperating strips of pressure seal adhesive disposed adjacent the first edge and the second fold line, and similarly widely spaced patterns of pressure seal adhesive are adjacent the third and fourth edges.

The business form constructed according to the present invention is formed by Z-folding the intermediate about the fold lines, and running it through a pressure sealer to seal the adhesive means. Also, where the intermediate has tractor drive strips, those are slit off (defining the first and second edges). When using the business form, one merely removes the release strips covering the two (or more) strips of transfer tape, allowing the form to be easily attached to a package. The transfer tape is much less expensive than label stock yet does a completely satisfactory job in holding the form in place on a package, for use as a packing slip/invoice. Invoice indicia is preferably printed on the first face second and third panels.

It is the primary object of the present invention to provide for a simple and easy and cost effective business form suitable for use as a packing list or invoice. This and other objects of the invention will become clear from an inspection of the detailed description of the invention, and from the appended claims.

BRIEF DESCRIPTION OF THE DRAWINGS

FIG. 1 is a top plan view of a first face of an intermediate for a business form according to the present invention;

FIG. 2 is a top plan view of a second face of the intermediate of FIG. 1;

FIG. 3 is a rear perspective view of the intermediate of FIGS. 1 and 2 being Z-folded into a business form, with the release strips on the transfer tape shown in the act of being removed;

FIG. 4 is a front view of a business form constructed from the intermediate of FIGS. 1 and 2, showing detachment along a perforation during opening of the form;

FIG. 5 is a front plan view of the form of FIG. 4 after opening, and folded along an adhesive line between the first and second panels; and FIG. 6 is a view like that of FIG. 5 only showing the form folded about a fold line between the second and third panels.

DETAILED DESCRIPTION OF THE DRAWINGS

An exemplary business form intermediate according to the present invention is shown generally by reference numeral 10 in FIGS. 1 and 2. The intermediate 10 is constructed of a single sheet of plain paper, for example bond paper, label stock not used to construct the intermediate 10. The sheet of paper 10 has a first face 11 (seen in FIG. 1), and a second face 12 (see FIG. 2). The intermediate 10 also comprises first and second edges 13, 14 that are opposite and substantially parallel to each other, and third and fourth edges 15, 16, respectively which are opposite to each other and substantially perpendicular to the first and second edges 13, 14.

Means are provided defining first and second fold lines 17, 18 in the sheet 10, extending parallel to the edges 13, 14. The fold lines 17, 18 may be lines of weakness (e.g. perforations), or may be score lines, but preferably are lines of weakness. They define the sheet 10 into three different panels of substantially equal size, a first panel 21, a second panel 22, and a third panel 23. The second panel 22 is between the fold lines 17, 18, and the first and third panels 21, 23.

Disposed on the second face 12 of the third panel 23 are two or more strips of transfer tape 25, extending substantially perpendicular to the third and fourth edges, 15, 16, and extending substantially the entire distance between the edges 15, 16. Of course transfer tape comprises adhesive 26 (see FIG. 3) covered a release strip 27, and is applied to the third panel 23 rear face 12 merely by placing the adhesive portion thereof in contact with the face 12. The adhesive 26 has a greater affinity for the bond paper 10 than it does for the release strip 27, therefore when the release strip 27 is removed the adhesive 26 will remain on the paper 10.

Address indicia is printed on the first face 11 on the first panel 21. The address indicia in the final form will comprise name, street address, city and state, etc., but even in the intermediate 10 prior to printing of a full address, address indicia will be provided at least in the form of shipping indicia 29, and an area for the actual address information to be printed (e.g. see the "ship to"indicia 30 in FIGS. 1 and 4).

The intermediate 10 further comprises first adhesive means disposed on the first face 11 second and third panels 22, 23 for holding the second and third panel first faces in face-to-face contact in the business form ultimately constructed from the intermediate. The first adhesive means preferably comprises elongated cooperating strips 32, 33 of pressure seal adhesive, such as that of U.S. Pat. No. 4,918,128. The strips 32 are disposed adjacent the first fold line 17, and the strips 33 adjacent the second edge 14. The first adhesive means also preferably comprises widely spaced patterns (e.g. dots or small squares or rectangles) of pressure seal adhesive, including the patterns 34 adjacent the edges 15, 16 of the second panel 22, and the patterns 35 adjacent the edges 15, 16 of the third panel 23.

Lines of weakness are also preferably formed in the intermediate 10 to allow ready opening of the final form constructed thereby, despite the adhesive strips 32, 33. For example a first line of weakness 37 is disposed in the first panel, a second line of weakness 38 in the second panel 22, and a third line of weakness 39 in the third panel 33. The lines of weakness 37 through 39 are preferably perforations. The strips 32 are between the first fold line 17 and the second line of weakness 38, and the strips 33 are between the third line of weakness 39 and the second edge 14.

The strips 32, 33 are substantial enough (essentially extending the entire width of the intermediate 10, that is between the edges 15, 16) that it is not feasible to separate the panels connected together in face-to-face relationship at the areas of the strips 32, 33, however the patterns 34, 35 are widely spaced and of small extent so that the faces that they hold together can be readily separated.

The intermediate 10 also comprises second adhesive means disposed on the second face 12 for holding the first and second panels 21, 22 second faces in face-to-face contact in a business form constructed from the intermediate 10. The second adhesive means preferably comprises elongated cooperating strips 41, 42 of pressure seal adhesive. The strips 41 are in the first panel 21 adjacent the first edge 13, while the strips 42 are in the second panel 22 adjacent the second fold line 18. The second adhesive means also comprises the widely spaced pressure seal pattern 43, 44 disposed in the panels 21, 22 respectively adjacent the edges 15, 16 thereof. The strips 41, 42 are comparable to the strips 32, 33, and the patterns 43, 44 comparable to the patterns 34, 35.

In addition to the address printing, preferably invoice printing (indicia) is provided on the first face 11 of the panels 22, 23. For example see the invoice indicia 46 on the panel 22, and corresponding invoice information — such as the invoice number — 47 in the panel 23.

The intermediate 10 also may comprise tractor drive portions which are provided before the final business form is constructed. For example there can be tractor drive portions 48, 49 (see FIG. 2) adjacent the edges 13, 14 respectively. When in that configuration, the edges 13, 14 are defined by slit lines, and before the construction of the final form the sheet 10 is slit at the lines (13, 14) cutting off the tractor drive portions 48, 49. Also, in the intermediate form the sheet 10 can be in continuous format. For example it can be connected at the edges 15, 16 by perf lines (defining the edges 15, 16) to identical sheets, such as the sheet 50 shown partially and schematically in FIG. 1.

FIG. 3 shows the business form which serves as a packing slip or invoice as it is being constructed. The finally constructed, Z-folded form, is illustrated generally by reference numeral 52 in FIG. 4. The Z-folded form is formed by folding the intermediate 10 about the lines 17, 18 bringing the adhesive strips 32, 33 into contact with each other, and the strips 41, 42 in contact with each other. Then the form is passed through a pressure sealer, such as the Moore 4800 Speedisealer ® pressure seal equipment. The pressure seal adhesive, such as shown in earlier referenced U.S. Pat. No. 4,918,128, available from Toppan Moore of Japan under the designation "TM24", or like conventional pressure seal adhesive, is acted upon by rollers only at the marginal portions of the form, to seal the pressure seal adhesive portions together.

In order to open the form 52, one detaches the portions 53 at the perf lines 37-39. Once the strip 53 — which is "top" of the form — is removed, the first panel 21 can be folded down along the adhesive strips 41, 42 where it is connected to the second panel 22, to allow viewing of the second face 12 of the panels 21, 22, and any indicia printed thereon. This is illustrated in FIG. 5. As illustrated in FIG. 6, the panels 22, 23 may be folded about the second fold line 18, downwardly, to reveal the invoice indicia 46, 47. Since the fold line 18 also preferably is a perf line, the invoice printed on the first face 11 of the second panel 22 may be detached, while the invoice information on the first face 11 of the third panel 23 may be retained as a record.

It will thus be seen that according to the present invention a business form intermediate, and business form constructed by Z-folding the intermediate, are provided which are simple and easy to construct, inexpensive — since they may be formed from a single sheet of bond paper, applying just a few strips of transfer tape thereto —, having much less pad lean than prior art constructions, having a consistent seal due to the pressure seal adhesive, and being simple to open by the end user. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and products.

What is claimed is:

1. A business form intermediate for constructing suitable for use as a packing list or invoice, comprising:

a sheet of paper having a first face and a second face, first and second edges opposite and substantially parallel to each other, and third and fourth edges opposite to each other and substantially perpendicular to said first and second edges;

means defining first and second fold lines in said sheet extending parallel to said first and second edges, and dividing said sheet into first, second, and third panels roughly equal in size, said second panel being intermediate said first and third panels;

two or more strips of transfer tape disposed on said second face of said third panel, said strips extending substantially perpendicular to said third and fourth edges, and being spaced from each other in the dimension extending from said first to said second edges;

address indicia printed on said first panel first face;

first adhesive means disposed on said first face of said second and third panels for holding said second and third panel first faces in face-to-face contact in the business from constructed by said intermediate; and second adhesive means disposed on said second face of said first and second panels for holding said first and second panel second faces in face-to-face contact in the business form constructed by said intermediate.

2. An intermediate as recited in claim 1 further comprising first and second lines of weakness extending parallel to said first fold line and straddling said first fold line, said first line of weakness disposed in said first panel and said second line of weakness disposed in said second panel.

3. An intermediate as recited in claim 2 wherein said second fold line is a line of weakness.

4. An intermediate as recited in claim 3 further comprising a third line of weakness extending parallel to said fold lines adjacent said second edge.

5. An intermediate as recited in claim 4 wherein said first adhesive means comprises elongated cooperating strips of pressure seal adhesive disposed between said first fold line and said second line of weakness, and between said third line of weakness and said second edge.

6. An intermediate as recited in claim 5 wherein said first adhesive means further comprises cooperating widely spaced patterns of pressure seal adhesive disposed adjacent said third and fourth edges in said second and third panels.

7. An intermediate as recited in claim 3 wherein said second adhesive means comprises elongated cooperating strips of pressure seal adhesive parallel to said first and second edges, and disposed adjacent said first edge and adjacent said second fold line.

8. An intermediate as recited in claim 7 wherein said second adhesive means further comprises cooperating widely spaced patterns of pressure seal adhesive disposed adjacent said third and fourth edges in said first and second panels.

9. An intermediate as recited in claim 1 further comprising severable tractor drive strips integral with said sheet at said first and second edges.

10. An intermediate as recited in claim 9 in continuous format, said third and fourth edges being connected to like edges of like intermediates along lines of weakness defining said third and fourth edges.

11. A business form suitable for use as a packing list or invoice, comprising:

a sheet of paper having a first face and a second face, first and second edges opposite and substantially parallel to each other, and third and fourth edges opposite to each other and substantially perpendicular to said first and second edges;

means defining first and second fold lines in said sheet extending parallel to said first and second edges, and dividing said sheet into first, second, and third panels roughly equal in size, said second panel being intermediate said first and third panels, and said sheet Z-folded about said fold lines so that said second faces of said first and second panels are in face-to-face engagement with each other, and said first faces of said second and third panels are in face-to-face engagement with each other;

two or more strips of transfer tape disposed on said second face of said third panel, said strips extending substantially perpendicular to said third and fourth edges, and being spaced from each other in the dimension extending from said first to said second edges;

address indicia printed on said first panel first face;

first adhesive means disposed on said first face of said second and third panels for holding said second and third panel first faces in face-to-face contact; and second adhesive means disposed on said second face of said first and second panels for holding said first and second panel second faces in face-to-face contact.

12. A business form as recited in claim 11 further comprising invoice indicia printed on said first face second panel.

13. A business form as recited in claim 12 further comprising invoice indicia information printed on said first face of said third panel; and wherein said address indicia includes a name, street address, and city and state or country address.

14. An intermediate as recited in claim 11 further comprising first and second lines of weakness extending parallel to said first fold line and straddling said first fold line, said first line of weakness disposed in said first panel and said second line of weakness disposed in said second panel.

15. An intermediate as recited in claim 14 wherein said second fold line is a line of weakness.

16. An intermediate as recited in claim 15 further comprising a third line of weakness extending parallel to said fold lines adjacent said second edge.

17. An intermediate as recited in claim 16 wherein said first adhesive means comprises elongated cooperating strips of pressure seal adhesive disposed between said first fold line and said second line of weakness, and between said third line of weakness and said second edge.

18. An intermediate as recited in claim 17 wherein said first adhesive means further comprises cooperating widely spaced patterns of pressure seal adhesive disposed adjacent said third and fourth edges in said second and third panels.

19. An intermediate as recited in claim 15 wherein said second adhesive means comprises elongated cooperating strips of pressure seal adhesive parallel to said first and second edges, and disposed adjacent said first edge and adjacent said second fold line.

20. An intermediate as recited in claim 19 wherein said second adhesive means further comprises cooperating widely spaced patterns of pressure seal adhesive disposed adjacent said third and fourth edges in said first and second panels.

* * * * *